US006791501B2

(12) United States Patent
Maeda et al.

(10) Patent No.: US 6,791,501 B2
(45) Date of Patent: Sep. 14, 2004

(54) VEHICLE ROOF MOUNT ANTENNA

(75) Inventors: Hiroyuki Maeda, Zama (JP); Junichi Kohinata, Tokyo (JP); Masaki Shinkawa, Yamato (JP); Morihiro Inomata, Wako (JP); Yasuyuki Shigefuji, Wako (JP); Hitoshi Otsuka, Wako (JP)

(73) Assignees: Harada Industry Co., Ltd., Tokyo (JP); Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/315,593

(22) Filed: Dec. 10, 2002

(65) Prior Publication Data

US 2003/0112191 A1 Jun. 19, 2003

(30) Foreign Application Priority Data

Dec. 14, 2001 (JP) ..... 2001-381555
Oct. 11, 2002 (JP) ..... 2002-299117

(51) Int. Cl.[7] ..... H01Q 1/32; H01Q 9/30
(52) U.S. Cl. ..... 343/715; 343/900
(58) Field of Search ..... 343/715, 878, 343/882, 906, 713, 900, 903

(56) References Cited

U.S. PATENT DOCUMENTS 5,661,497 A * 8/1997 Calearo ..... 343/715
6,062,912 A * 5/2000 Witczak et al. ..... 439/680
6,317,087 B1 * 11/2001 Laugal et al. ..... 343/702
6,486,842 B2 * 11/2002 Wang ..... 343/715
6,486,843 B2 * 11/2002 Wang et al. ..... 343/715

* cited by examiner

*Primary Examiner*—Haissa Philogene
*Assistant Examiner*—Minh Dieu A
(74) *Attorney, Agent, or Firm*—Frishauf, Holtz, Goodman & Chick, P.C.

(57) ABSTRACT

The present invention includes an antenna rod, an antenna base which attaches the antenna rod so as to be capable of swiveling, a joint assembly which consists of a cylindrical member in an axial direction orthogonal to an axial direction of the rod at one end of the antenna rod, a pair of pivotal support portions provided so as to confront an upper portion of the antenna base so as to mount the joint assembly on a pivot in a swiveling manner, and a torsion spring which is provided with respect to the joint assembly and automatically returns the joint assembly to a predetermined swiveling position by giving the elasticity of itself even if a swiveling position of the joint assembly is changed due to an external force applied to the antenna rod.

14 Claims, 7 Drawing Sheets

VEHICLE ROOF MOUNT ANTENNA

CROSS-REFERENCE TO RELATED APPLICATIONS

This application is based upon and claims the benefit of priority from the prior Japanese Patent Applications No. 2001-381555, filed Dec. 14, 2001; and No. 2002-299117, filed Oct. 11, 2002, the entire contents of both of which are incorporated herein by reference.

BACKGROUND OF THE INVENTION

1. Field of the Invention

The present invention relates to a vehicle roof mount antenna.

2. Description of the Related Art

FIG. 1 show an example of a concrete structure of a swiveling pivotal mount portion of a general retractable type vehicle roof mount antenna 10 in particular. Reference numeral 11 denotes an antenna rod, and 12 designates an antenna base used to attach the antenna rod 11. A joint assembly 13 which is attached to the antenna base 12 is provided at the lower end of the antenna rod 11.

This joint assembly 13 consists of a cylindrical member with a bottom in an axial direction orthogonal to an axial direction of the antenna rod 11. As shown in FIG. 2, a pair of hemispheric convex portions 131, 131 distanced from each other at 180° with a central position therebetween are formed on the inner surface of the bottom of the cylindrical member with the bottom of the joint assembly 13. These convex portions 131, 131 are formed in order to give a feeling of clicking to swiveling of the antenna rod. An outer surface of the bottom of the cylindrical member with the bottom functions as a terminal portion (not shown) used to propagate an antenna signal obtained by the antenna rod 11.

Further, in order to mount the joint assembly 13 on a pivot to allow swiveling, a pair of pivotal support portions 12*a*, 12*b* are formed so as to confront the upper part of the antenna base 12. A circular hole 121 having a confronting direction as an axial direction is formed to one pivotal support portion 12*a*. A terminal portion 122 which is brought into contact with and electrically connected to the terminal portion of the joint assembly 13 is formed on the inner surface of the other pivotal support portion 12*b* opposed to the circular hole 121.

With the joint assembly 13 being positioned between the pivotal support portions 12*a* and 12*b* with an O ring 23 interposed between the terminal portion of the joint assembly 13 and the terminal portion 122 of the pivotal support portion 12*b*, a click cylinder 14 is inserted from the circular hole 121 of the pivotal support portion 12*a* through an opening of the cylindrical member with the bottom of the joint assembly 13.

This click cylinder 14 has a plate 14*a* embedded on the outer surface side of the bottom of the cylindrical member with the bottom. This plate 14*a* is manufactured by, e.g., press working, and a plurality of pairs of circular holes 141, 141, corresponding to a plurality of click positions fitted to the convex portions 131, 131 are formed.

Concave and convex shapes which engage with each other are mutually formed in the vicinity of the end portion of the outer peripheral surface on the open side of the click cylinder 14 where the plate 14*a* is not embedded and on the inner surface of the circular hole 121 of the pivotal support portion 12*a* in order to suppress swiveling of the click cylinder 14 on the surface orthogonal to the axial direction of the circular hole 121.

A coil spring 15 is inserted from the open side of the click cylinder 14 through a washer 16. Further, like the click cylinder 14, a washer 17 whose swiveling action is suppressed on a surface orthogonal to the axial direction of the circular hole 121 in the circular hole 121 of the pivotal support portion 12*a* is inserted.

In this state, the washer 17, the coil spring 15, the washer 16, the bottom plate 14*a* of the click cylinder 14, and the terminal portion of the pivotal support portion 12*b* are pierced by a bolt 18. Then, a nut 22 is fastened from the end of the bolt 18 on the outer surface side of the pivotal support portion 12*b* through a corrugated washer 19, a washer 20 and a spring washer 21, thereby constituting this pivotal mount swiveling portion.

In such a structure, the convex portions 131, 131 of the joint assembly 13 are fitted to one pair of the circular holes 141, 141, . . . formed on the bottom plate 14*a* of the click cylinder 14 coming into contact with the convex portions 131, 131.

A click torque is generated by the elasticity of the coil spring 15 when fitting. The terminal portion of the joint assembly 13 is electrically connected by the frictional sliding with the terminal portion 122 of the pivotal support portion 12*b* pushed by the elasticity of the corrugated washer 19, and an antenna signal obtained by the antenna rod 11 is propagated into the antenna base 12.

FIG. 3 shows an exterior appearance of the vehicle roof mount antenna 10 having the above-described structure. A coaxial cable 24 is extended to the antenna base 12 from its lower surface. A connection plug 25 used to establish connection with a tuner of a car having the vehicle roof mount antenna 10 mounted thereon is provided at the end of the coaxial cable 24.

The antenna rod 11 has a retractable structure such that it can be fixed to the antenna base 12 in any one of three positions, e.g., 0°, 60° and 180°. By adjusting the click torque described in connection with FIG. 1, an appropriate feeling of clicking is given so as to assuredly fix the antenna rod 11 in each position.

By mounting the vehicle roof mount antenna 10 in such a manner that a traveling direction of a car is a left direction in the drawing while taking the influence of a traveling wind into consideration, the air pressure during the regular traveling can be minimized.

In case of parallel parking and the like, the antenna rod 11 is manually fixed in the position of 0° or 180° in order to prevent the vehicle roof mount antenna 10 from being damaged when it physically interferes with a roof and the like.

In the structure of the above-described vehicle roof mount antenna 10, however, an attachment angle of the antenna rod 11 is held as shown in FIG. 3.

When the antenna rod 11 has interfered with a ceiling in a garage whose height is limited, for example, the antenna rod 11 is held in the retracted state in accordance with a traveling direction of a vehicle. Therefore, a driver of the car must again manually return the antenna rod 11 to the angle of 60° indicated by a solid line in FIG. 3 after moving the vehicle out of the garage.

With respect to handling of such an antenna rod 11, if a hand hardly gets at the antenna rod 11 when a driver is particularly small, or when the attachment position of the vehicle roof mount antenna 10 is at the center of the roof, or when a position of the roof itself is high in case of a minivan type vehicle and the like, there occurs a problem that the trouble of handling the antenna is complicated and the stain on a body of the vehicle may adhere to a cloth in some cases.

In case of a minivan type vehicle which may have an air spoiler attached at the upper end of a rear door, if the antenna rod 11 is provided at the rear end of the roof, the air spoiler may interfere with the antenna rod 11 when the rear door is opened. Therefore, a vehicle manufacturer has a drawback that an attachment position of the antenna rod 11 must be restricted on the design stage.

In order to eliminate the above-described problems, there has been also considered an antenna having an electric mechanism such that the attachment angle of the antenna rod 11 can be freely variably set from the inside of a car. However, a structure of the apparatus, attachment to a car, arrangement of wirings and others are complicated, which leads to a very high cost.

BRIEF SUMMARY OF THE INVENTION

It is an object of the present invention to provide a vehicle roof mount antenna which has a very simple structure but can prevent an antenna rod protruding from a vehicle from being damaged by an external force and can automatically and easily return an attachment angle to a predetermined position.

According to the present invention, there is provided a vehicle roof mount antenna comprising: an antenna rod; an antenna base which attaches the antenna rod so as to be capable of swiveling; a joint portion which is provided at one end of the antenna rod and consists of a cylindrical member in an axial direction orthogonal to an axial direction of the rod; a pair of pivotal support portions confronting the upper portion of the antenna base so as to mount the joint portion on a pivot in a swiveling manner; and a bolt and a nut which are inserted into a through hole provided to one of a pair of the pivotal support portions, pierce the joint portion and the other pivotal support portions and are fastened together; and a spring mechanism which is provided with respect to the joint portion in the antenna base and automatically restore the joint portion and the antenna rod to a predetermined swiveling position by giving its elasticity even if the swiveling position of the joint portion and the antenna rod is changed by an external force applied to the antenna rod.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION (First Embodiment)

A first embodiment according to the present invention will now be described hereinafter with reference to the accompanying drawings.

Figure 4A:
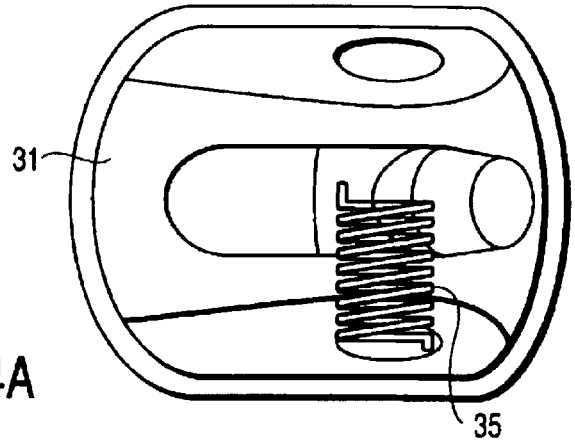
FIGS. 4A and 4B are views showing a structure of a vehicle roof mount antenna according to a first embodiment of the present invention.
Figure 4B:
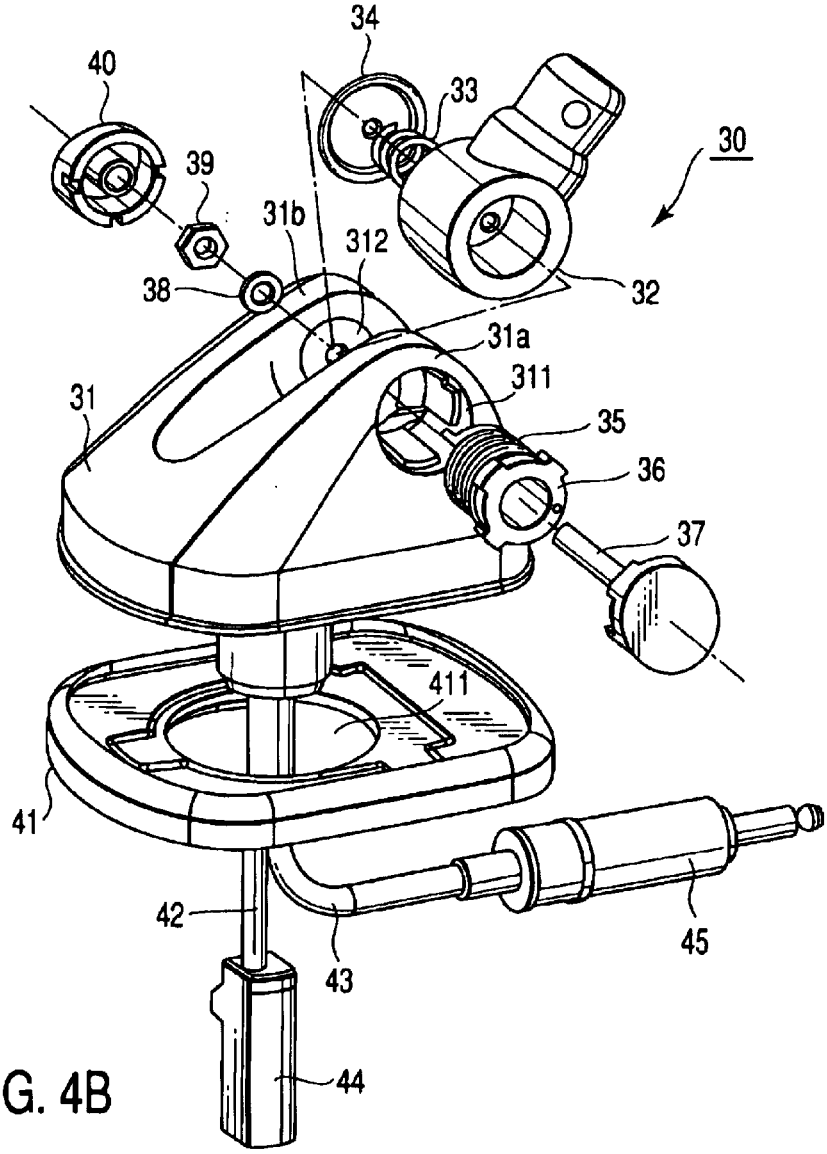

FIGS. 4A and 4B show a concrete structure of a swiveling pivotal mount portion of a vehicle roof mount antenna 30 according to this embodiment in particular. In FIG. 4B, reference numeral 31 denotes an antenna base used to attach a non-illustrated antenna rod, and a joint assembly 32 is provided on the lower end side of the antenna rod which is attached to this antenna base 31.

The joint assembly 32 consists of a cylindrical member with a bottom in an axial direction orthogonal to an axial direction of the antenna rod. The outer surface of the bottom of the cylindrical member with the bottom functions as a terminal portion (not shown) used to propagate an antenna signal obtained by the antenna rod.

Further, in order to mount the joint assembly 32 on a pivot so as to be capable of swiveling, a pair of pivotal support portions 31*a* and 31*b* are formed. The pivotal support portions 31*a* and 31*b* are formed so as to confront the upper portion of the antenna base 31. A circular hole 311 whose confronting direction is determined as an axial direction is formed to one pivotal support portion 31*a*. A terminal portion 312 which is brought into contact with and electrically connected with the terminal portion of the joint assembly 32 is formed on the inner surface of the other pivotal support portion 31*b* which is opposed to the circular hole 311.

With the joint assembly 32 being positioned between the pivotal support portions 31*a* and 31*b* so as to interpose a coil spring 33 and a terminal plate 34 between the terminal portion of the joint assembly 32 and the terminal portion 312 of the pivotal support portion 31*b*, a torsion spring 35 and a cylinder 36 are coaxially inserted from the circular hole 311 of the pivotal support portion 31*a* through the opening of the cylindrical member with the bottom of the antenna base 31.

This cylinder 36 has irregularities which are fitted with irregularities formed on the inner surface of the circular hole 311 on the outer surface of the circumferential wall portion on the upper end side of the cylindrical shape with the bottom, and one end of the torsion spring 35 is fixed to this cylinder 36. The other end of the torsion spring 35 is fixed to the joint assembly 32 on the bottom side.

A bolt 37 which also functions as a concealed cover is inserted from the open side of the cylinder 36 and caused to pierce the cylinder 36, the torsion spring 35, the bottom portion of the joint assembly 32, and coil spring 33, the terminal plate 34, and the terminal portion 312. Then, the end of the bolt 37 is fastened by using a nut 39 through a washer 38 from the outer surface side of the pivotal support portion 31*b*, thereby constituting the pivotal mount swiveling portion.

In order to cover the end of the bolt 37 and the nut 39, a concealed cover 40 conforming to the outer surface shape of the antenna base 31 is fitted.

A base mat 41 which conforms to the lower surface shape of the antenna base 31 and consists of, e.g., rubber is arranged on the lower portion of the antenna base 31. The base mat 41 has an opening 411 at the substantially central part thereof. A power supply cord 42 for an amplifier built in the antenna base 31 and a radio tuner coaxial cable 43 are connected to the lower surface of the antenna base 31 through the opening 411 of the base mat 41. A power supply connector 44 is connected to the end of the power supply cord 42. A radio plug 45 is connected to the end of the radio tuner coaxial cable 43.

One end of a torsion spring 35 assembled in the joint assembly 32 having the cylindrical shape with a bottom is fixed to the cylinder 36 secured to the antenna base 31, and the other end of the same is fixed to the joint assembly 32 mounted on a pivot so as to be capable of swiveling.

Assuming that the torsion spring 35 is attached with a sufficient torsion force acting, the joint assembly 32 and the antenna rod attached to the joint assembly 32 are pressed in one direction in accordance with the elasticity of the torsion spring 35.

Figure 3:
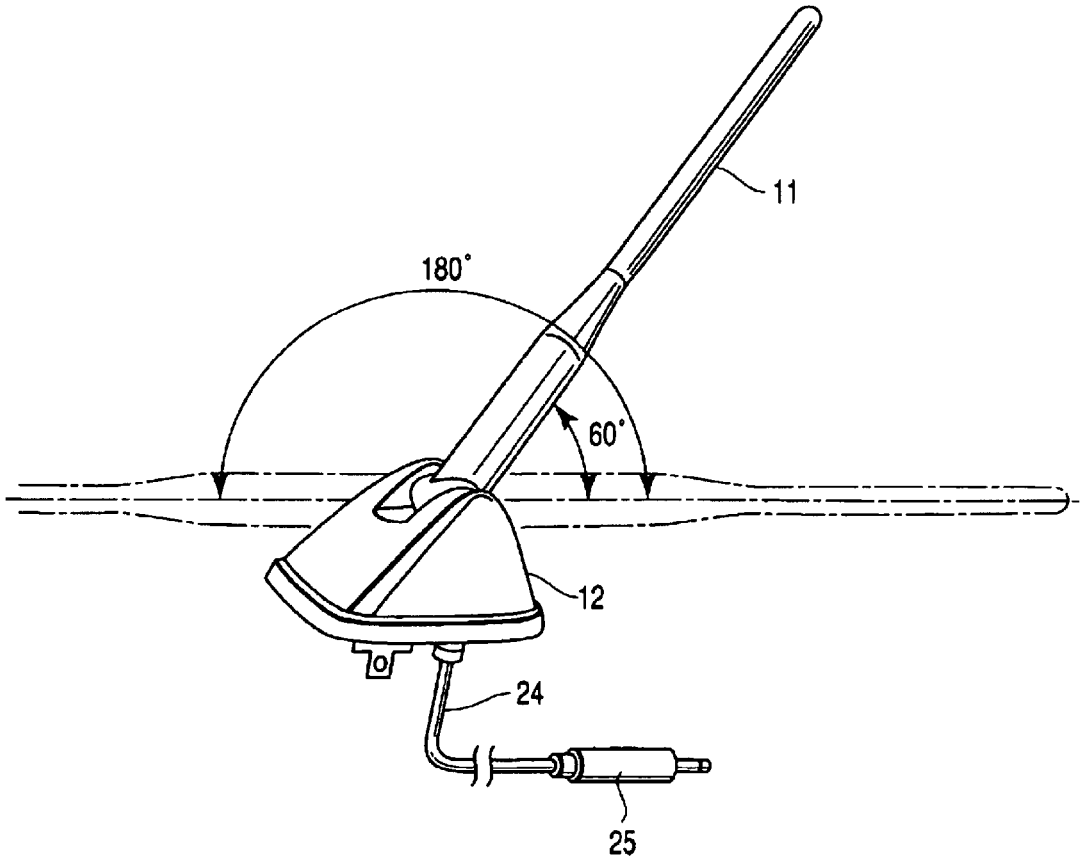
FIG. 3 (PRIOR ART)
FIG. 3 is a perspective view showing an exterior structure of the vehicle roof mount antenna depicted in FIG. 1.

For example, explaining on the attachment angle shown in FIG. 3, the state of being inclined toward the rear side of a vehicle at an angle of 60° is determined to fall with a range being capable of swiveling toward the rear side of the antenna rod, and the antenna base 31 is formed into a shape which can not swivel beyond this range. Moreover, assuming that the torsion force of the torsion spring 35 toward the rear side of a vehicle constantly acts on the joint assembly 32 and the antenna rod, when any other external force does not act on the antenna rod, the antenna rod always maintains the angle of 60° toward the rear side.

For example, when putting a vehicle in the back direction into a garage whose height is restricted, if the external force in the vehicle front direction which surpasses the torsion force of the torsion spring 35 acts on the antenna rod, the antenna rod and the joint assembly 32 swivel in the vehicle front direction by this external force.

Thereafter, when there is no external force acting on the antenna rod, the joint assembly 32 and the antenna rod are automatically restored to the original angle inclined at 60° in the vehicle rear direction by the torsion force of the torsion spring 35.

In the structure described in connection with the first embodiment, when the external force in the vehicle rear direction further acts on the antenna rod in the regular state, the joint assembly 32 can not further swivel, and the joint assembly 32 or the antenna rod may be damaged depending on a magnitude of the external force acting thereon.

Therefore, it is possible to avoid the above-described case which leads to the damage by providing a certain degree of an elastic body structure to the antenna rod itself, e.g., by using a material having the elasticity and flexibility such as a resin material as a core material and a cover member which are antenna elements in order to absorb this external force.

As described above, according to the first embodiment of the present invention, there is realized a structure which automatically return to a predetermined swiveling position the antenna rod which is attached so as to be capable of swiveling by the simple mechanism using the spring.

Thus, the complicated trouble of manually returning the attachment angle can be saved while assuredly eliminating the influence of the external force onto the antenna rod protruding from a vehicle and avoiding a damage thereto.

Figure 1:
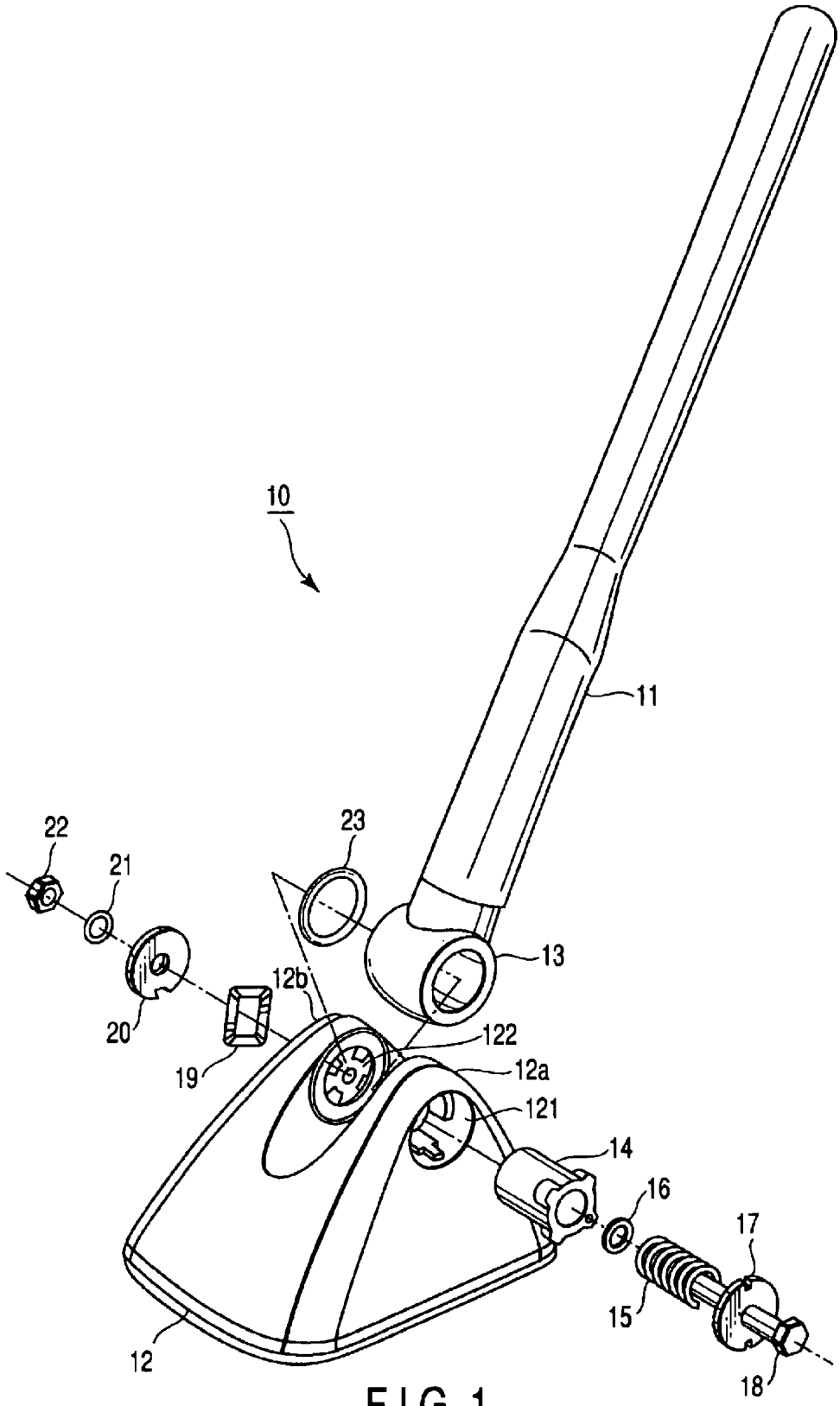
FIG. 1 (PRIOR ART)
FIG. 1 is a perspective view showing a concrete structure of a swiveling pivotal support portion of a conventional retractable type vehicle roof mount antenna.
Figure 2:
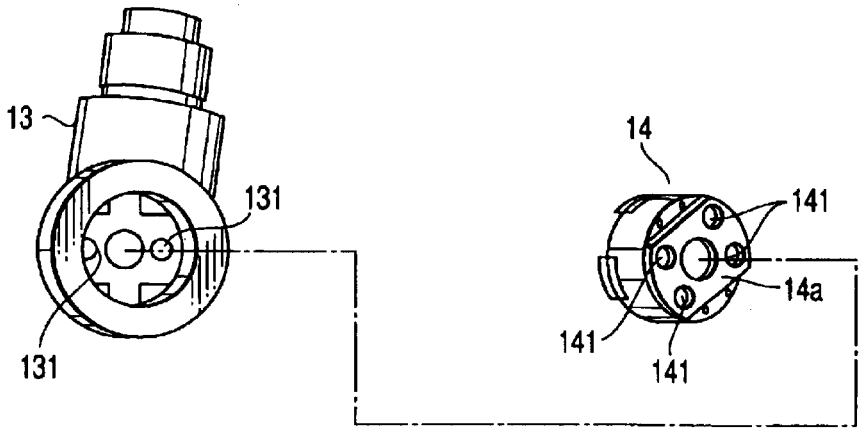
FIG. 2 (PRIOR ART)
FIG. 2 is a perspective view showing a concrete structure of a joint portion and a click cylinder illustrated in FIG. 1.

In addition, since the torsion spring 35 can be integrally assembled into the joint assembly 32, reduction in size can be facilitated. Additionally, the spring mechanism can be assembled without greatly changing the structure of the similar antenna apparatus having no conventional spring mechanism such as shown in FIG. 1.

It is to be noted that when the external force acts on the antenna rod and the torsion spring 35 is caused to swivel in the entrainment direction, it can be also considered that only a part of the torsion spring 35 in the vicinity to the fixed end secured to the joint assembly 32 is locally deformed in particular and the external force is absorbed.

Figure 5:
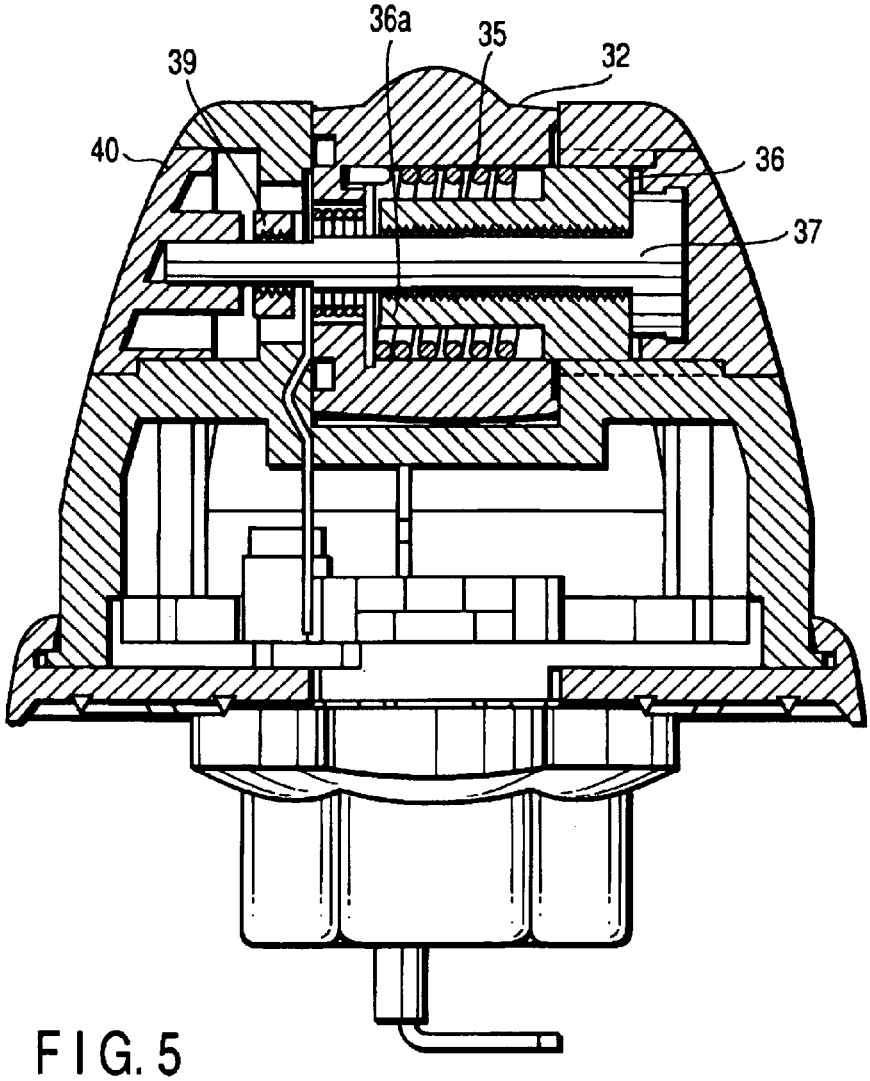
FIG. 5 is a cross-sectional view showing another structural example in an antenna base according to the first embodiment.

FIG. 5 shows a structure which avoids such a local deformation of the torsion spring 35. A cylindrical guide member 36*a* is provided coaxially with the joint assembly 32, the cylinder 36 and the bolt 37 and integrally with the cylinder 36.

In this case, an outside diameter of the guide member 36*a* is set to a value with which reduction in an inside diameter due to entrainment of the torsion spring 35 is restricted. Further, the guide member 36*a* is determined to consist of a material superior in the surface smoothness. When the inside diameter is partially reduced due to entrainment of the torsion spring 35, this reduction is restricted by the above-described factors, and it is transmitted as entrainment of the entire spring.

As a result, a local deformation which can be considered to be generated at the fixed end of the torsion spring 35 on the joint assembly 32 side can be restricted in particular, the durability of the entire spring can be improved, and a damage to the torsion spring 35 can be avoided.

Furthermore, the outer peripheral portion of the antenna rod may be determined to be constituted by a material having the elasticity such as rubber, a gap between a pair of the pivotal support portions 31*a* and 31*b* of the antenna base 31 may be set equal to the outside diameter of the antenna rod or slightly smaller than the same taking a deformation due to the elasticity of the outer surface of the antenna rod into consideration, and a sliding resistance may be generated between the antenna rod and the pivotal support portions 31*a* and 31*b* at the swiveling intermediate position of the antenna rod.

Figure 11:
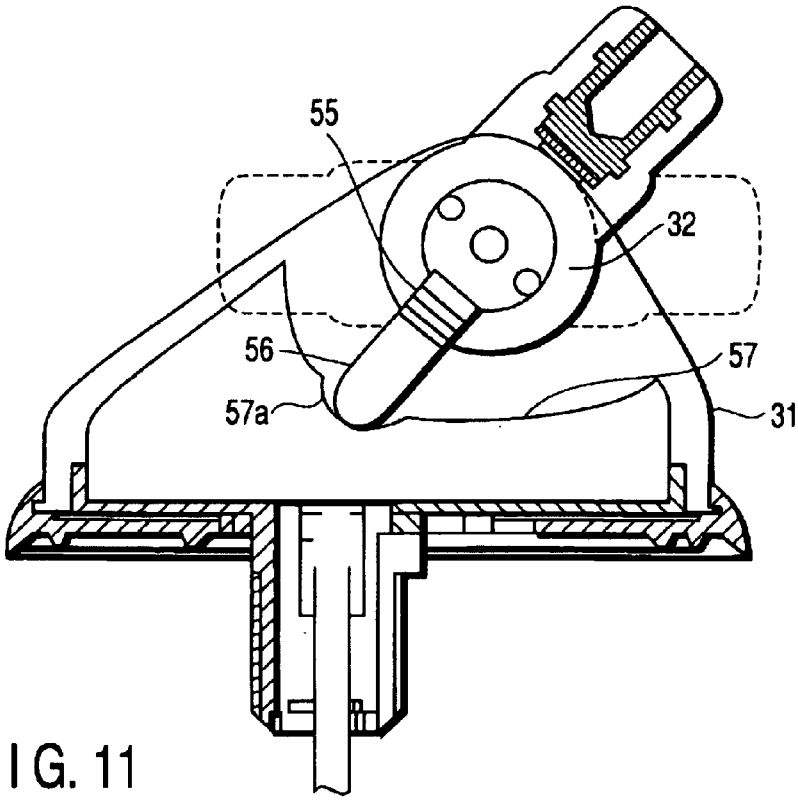
FIG. 11 is a view showing a structure of a vehicle roof mount antenna according to a fourth embodiment of the present invention.

In this case, the gap between a pair of the pivotal support portions 31*a* and 31*b* of the antenna base 31 is set larger than the outside diameter of the antenna rod at a corresponding position where the antenna mast shown in FIG. 11 forms an angle of 180°.

Figure 6:
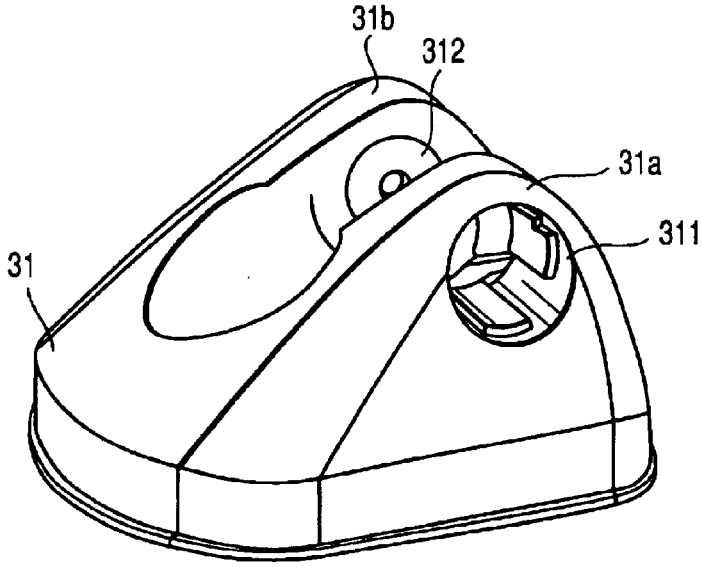
FIG. 6 is a cross-sectional view showing another structural example of a pivotal support portion of the antenna base according to the first embodiment.

FIG. 6 shows the exterior structure of such an antenna base 31. When the antenna rod is caused to swivel until its axial direction becomes horizontal, there is no sliding resistance applied to the antenna rod.

Therefore, when the antenna rod swivels by the external force, it is temporarily locked at a point in time that the antenna rod becomes horizontal, thereby maintaining the state that the antenna rod is accommodated.

It is to be noted that other various structural examples of the spring mechanism can be considered. Although description will be given as to each of second and other embodiments which can substitute the first embodiment, like reference numerals denote like or corresponding parts since the basic concept is similar, and only a concrete structural example of the spring mechanism will be focused in particular.

(Second Embodiment)

Figure 7:
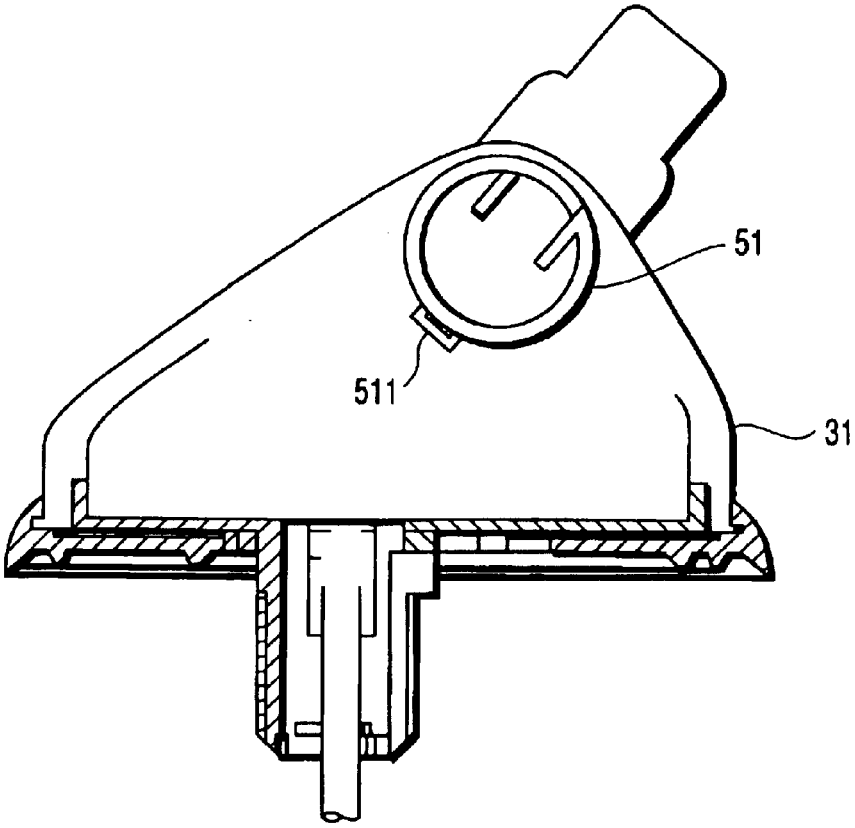
FIG. 7 is a view showing a structure of a vehicle roof mount antenna according to a second embodiment of the present invention.

FIG. 7 shows a structure of a vehicle roof mount antenna according to a second embodiment of the present invention.

In this drawing, a torsion spring 51 having the both ends fixed to the joint assembly 32 are used in place of the torsion spring 35 in FIG. 4.

For example, a coil central portion 511 of the torsion spring 51 is caused to partially protrude toward the circumferential surface side and engaged and fixed to the irregularities in the circular hole 311 in the pivotal support portion 31*a*, thereby preventing swiveling as a whole with swiveling of the joint assembly 32.

Moreover, as different from the first embodiment, the antenna base 31 has such a shape as that the joint assembly 32 and the antenna rod also swivel at an angle of 0° toward the vehicle rear side shown in FIG. 3.

The torsion spring 51 is provided with the joint assembly 32 and the antenna rod are inclined toward the vehicle rear side in the drawing, e.g., at the swiveling position of 60° when the torsion force caused due to the elasticity of the torsion spring 51 does not act in either direction.

With such a structure, when the external force in both the front and back directions of the vehicle acts on the antenna rod, the torsion force in the opposite direction by the torsion spring 51 is generated while the antenna rod and the joint assembly 32 swivel in the direction along which the external force is given, and the torsion force generated in the torsion spring 51 automatically restores the joint assembly 32 and the antenna rod to the angle inclined to the vehicle rear side at a point in time that the external force acting on the antenna rod is eliminated.

In this case, as the torsion spring 51, one having a slightly large wire diameter is selected in order to generate the torsion force in the both directions by using one spring, as compared with the torsion spring 35 in the first embodiment. Even if this point is taken into consideration, the spring mechanism can be assembled without changing the similar antenna apparatus which can be relatively easily reduced in size and has not conventional spring mechanism.

In addition, it can be also considered that a torsion spring 51' having both ends 51*a* and 51*b* thereof which are not fixed to both of the joint assembly 32 and the antenna base 31 is used in place of the torsion spring 51.

Figure 8:
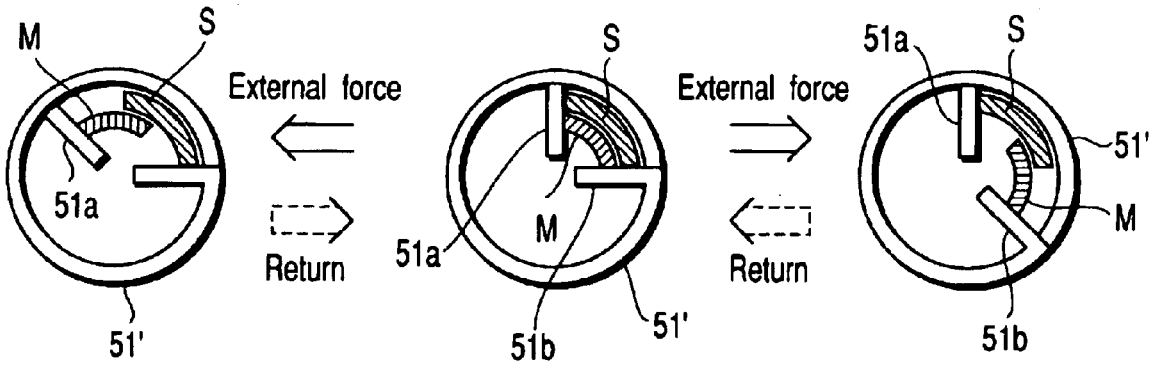
FIG. 8 is a view showing another structural example according to the second embodiment.

FIG. 8 mainly shows only the torsion spring 51' as another structural example of the second embodiment. It is determined that both ends 51*a* and 51*b* of the torsion spring 51' are extended in the central axial position direction along the surface vertical to the axis of the spring 51'.

Further, a fixed piece S and a movable piece M both having circular cross sections along the axis of the torsion spring 51' are coaxially arranged in the torsion spring 51'. Here, the fixed piece S is integrally fixed to, e.g., the cylinder 36 on the antenna base 31 side, and constituted by a platy member having a circular cross section slightly longer than the axial length of the torsion spring 51'.

On the other hand, the movable piece M is fixed on the joint assembly 32 side, and is likewise constituted by a platy member having a circular cross section slightly longer than the axial length of the torsion spring 51'.

In the home position where the external force is not given to the antenna rod illustrated at the center in the drawing, the fixed piece S and the movable piece M are arranged so as to be accommodated in an angular range sandwiched between the both ends 51*a* and 51*b* of the torsion spring 51'.

As shown on the left side of the drawing, when the external force in the counterclockwise direction in the drawing is applied to the antenna rod, the movable piece M fixed to the joint assembly 32 is brought into contact with and pressed against one end 51*a* of the torsion spring 51' with swiveling of the joint assembly 32, and this acts on the entire torsion spring 51' to swivel in the counterclockwise direction.

At this moment, since one end 51*b* of the torsion spring 51' is prevented from swiveling by the fixed piece S fixed on the antenna base 31 side, the torsion force is stored in the torsion spring 51' in accordance with the external force applied to the antenna rod.

Then, at a point in time that there is no external force applied to the antenna rod, the torsion force is released by the elasticity of the torsion spring 51', and the antenna rod returns to its original swiveling position.

The right side in the drawing shows the operation when the external force in the clockwise direction in the drawing is applied to the antenna rod. Although the roles of the both ends 51*a* and 51*b* of the torsion spring 51' change with those shown in the left part in the same drawing, the antenna rod is caused to restore to the original swiveling position by the elasticity of the torsion spring 51' at a point in time that the external force applied to the antenna rod is eliminated by the similar operation.

When such a structure is adopted, like the structure illustrated in FIG. 7, as the torsion spring 51', one having a slightly large wire diameter is selected in order to generate the torsion force in the both directions by one spring as compared with the torsion spring 35 in the first embodiment. Even if this point is taken into consideration, it is possible to assemble the spring mechanism without greatly changing the structure of the similar antenna apparatus which can be readily reduced in size and has no conventional spring mechanism.

(Third Embodiment)

Figure 9:
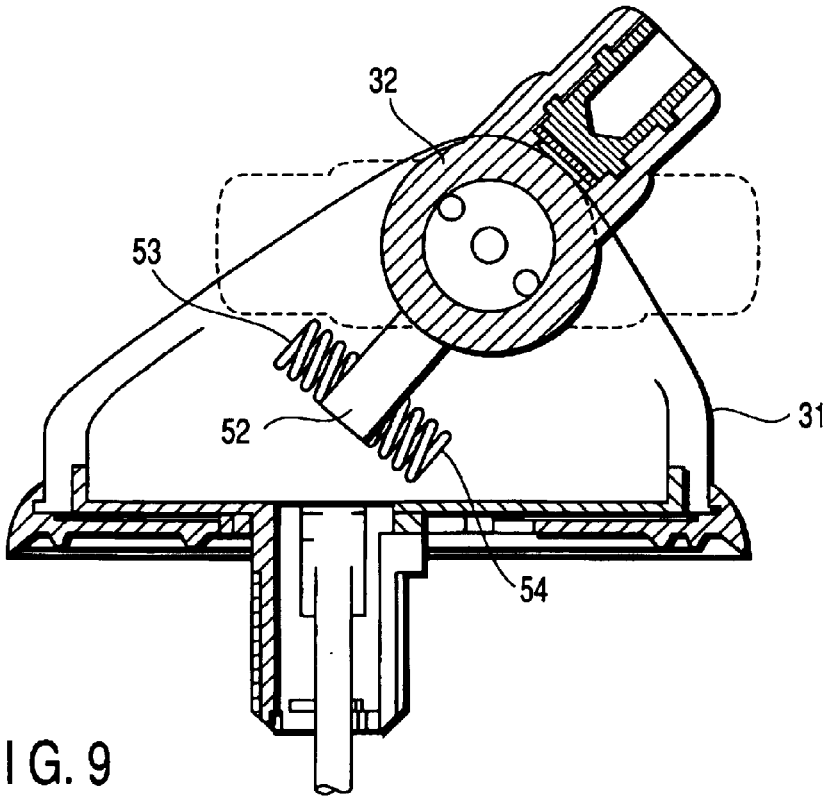
FIG. 9 is a view showing a structure of a vehicle roof mount antenna according to a third embodiment of the present invention.

FIG. 9 shows a structure of a vehicle roof mount antenna according to a third embodiment of the present invention.

In the drawing, it is determined that a platy member 52 protruding in the axial direction of the antenna rod is integrally provided to the joint assembly 32 on the inner side of the antenna base 31 opposite to the antenna rod and one end of each of a pair of coil springs 53 and 54 is attached along the swiveling direction of the joint assembly 32 with the platy member 52 sandwiched therebetween.

Each of the coil springs 53 and 54 is constituted by a compression spring. Although not shown, a wall surface is formed at a position coming into contact with the other end side of each of the coil springs 53 and 54 in the antenna base 31 so as to restrict the swiveling range of the joint assembly 32.

With such a structure, when the external force in either of the front or rear direction of a vehicle acts on the antenna rod, the antenna rod and the joint assembly 32 swivel in the direction along which the external force is given, and the coil spring 53 or 54 is further compressed in accordance with the external force even after the other end side of the coil spring 53 or 54 is brought into contact with the wall surface in the antenna base 31.

Then, at a point in time that the external force acting on the antenna rod is eliminated, the compression force generated in the coil spring 53 or 54 is released, and the joint assembly 32 and the antenna rod automatically return to the original swiveling angle inclined toward the rear side of a vehicle.

In this case, the operating stroke of the coil springs 53 and 54 is sufficiently long and the minimum compression length of the same is short. For example, conical coil springs are used and the other end of each coil spring is constantly in contact with the wall surface in the antenna base 31 even when the regular external force is not acting.

By adopting such a structure, when the compression force is not generated in the coil springs 53 and 54 at all or when a small compression force is generated in the both coil springs 53 and 54 and well balanced, the joint assembly 32 and the antenna are held at a predetermined swiveling position. Then, it is possible to prevent the antenna rod from unstably swiveling from a predetermined attachment angle position by small vibrations of a vehicle.

As described above, by employing a pair of the coil springs 53 and 54, the strong return force relative to a displacement of the antenna rod can be acquired while obtaining a relatively small structure.

Figure 10:
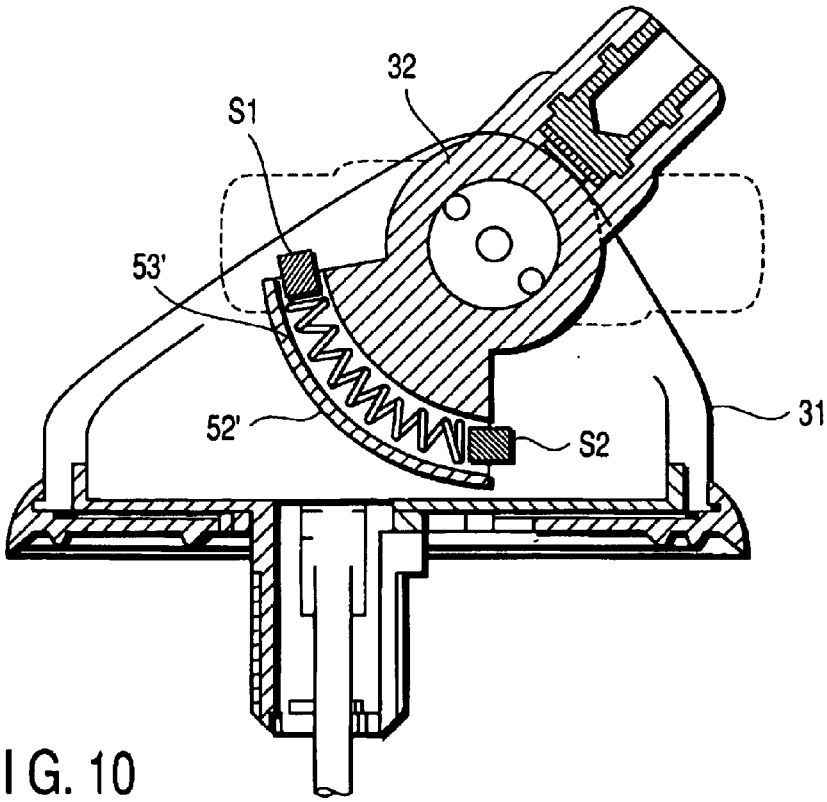
FIG. 10 is a view showing a another loading structure of a coil spring according to the third embodiment.

Furthermore, as a modification of the embodiment, a fan-shaped platy member 52' such as shown in FIG. 10 may be integrally provided to the joint assembly 32, a circular groove which is concentric to the center of swiveling of the joint assembly 32 may be formed in the platy member 52', and one coil spring 53' may be arranged therein.

In this case, the coil spring 53' is configured so as not to protrude toward the outside from the groove of the platy member 52', and fixed members S1 and S2 fixed to the antenna base 31 are in contact with and arranged at the both end positions of the coil spring.

With such a structure, when the external force is applied to the antenna rod and the antenna rod swivels, the coil spring 53' is brought into contact with the fixed member S1 or S2 and compressed irrespective of a direction of swiveling, and the antenna rod automatically returns to its original swiveling position when the external force applied to the antenna rod is eliminated by the compression force.

Therefore, the range of swiveling angle and retractability of the antenna rod relative to the external forced can be arbitrarily adjusted by appropriately setting a central angle of the fan-shaped platy member 52, a length and an elasticity of the coil spring 53' and arrangement of the fixed members S1 and S2.

(Fourth Embodiment)

FIG. 11 shows a structure of a vehicle roof mount antenna according to a fourth embodiment of the present invention.

In the drawing, a coil spring 55 is attached to the joint assembly 32 in such a manner that the axial direction of the coil spring 55 matches with the radial direction of the swiveling surface and the axial direction of the antenna rod. A slide pin 56 which has one end being in contact with the coil spring 55 and which is pressed by the elasticity of the coil spring 55 is attached.

The other end side of the slide pin 56 which is not in contact with the coil spring 55 has an end portion with a spherical shape having a small frictional resistance and comes into contact with a circumferential wall portion 57 formed in the antenna base 31.

The circumferential wall portion 57 is basically set in such a manner that a distance between a position where the end of the slide pin 56 is in contact with the circumferential wall portion and a central axial position of the joint assembly 32 becomes longest at a predetermined attachment position where no external force is applied to the antenna rod and that the distance to the central axial position of the joint assembly 32 gradually becomes short in the both directions as distanced from that position. When no external force is applied to the antenna rod, the swiveling angle of the antenna rod automatically returns by the elasticity of the coil spring 55 constituted by the compression coil spring in such a manner that the antenna rod is placed at a predetermined attachment angle position.

Moreover, on the circumferential wall portion 57 is formed a slightly convex center holding portion 57*a* which is symmetric in the right-and-left swiveling direction at the predetermined attachment angle position where no external force is applied to the antenna rod in particular with the position with which the end of the slide pin 56 comes into contact at the center.

When the external force applied to the antenna rod has a magnitude which is not more than a certain degree, the slide pin 56 does not come off the center holding portion 57*a* by the elasticity of the coil spring 55, and the attachment swiveling angle of the antenna rod is held.

With such a structure, when the external force in either the front direction or the rear direction of a vehicle acts on the antenna rod, the antenna rod and the joint assembly 32 swivel in the direction along which the external force is given in accordance with a magnitude of the external force, the end of the slide pin 56 slides along the circumferential wall portion 57, and the coil spring 55 is compressed in accordance with the external force.

Then, when the external force acting on the antenna rod is eliminated, the compression force generated in the coil spring 55 is released, the end of the slide pin 56 returns to the central position of the center holding portion 57*a* where the elasticity of the coil spring 55 becomes weakest, and the joint assembly 32 and the antenna rod automatically return to the original angle inclined toward the rear side of a vehicle.

In this case, with the structure of the coil spring 55 and the slide pin 56 and the structure of the circumferential wall portion 57 relative to these members, the configuration added to the joint assembly 32 on the movable side can be greatly reduced in size in particular.

(Fifth Embodiment)

Figure 12:
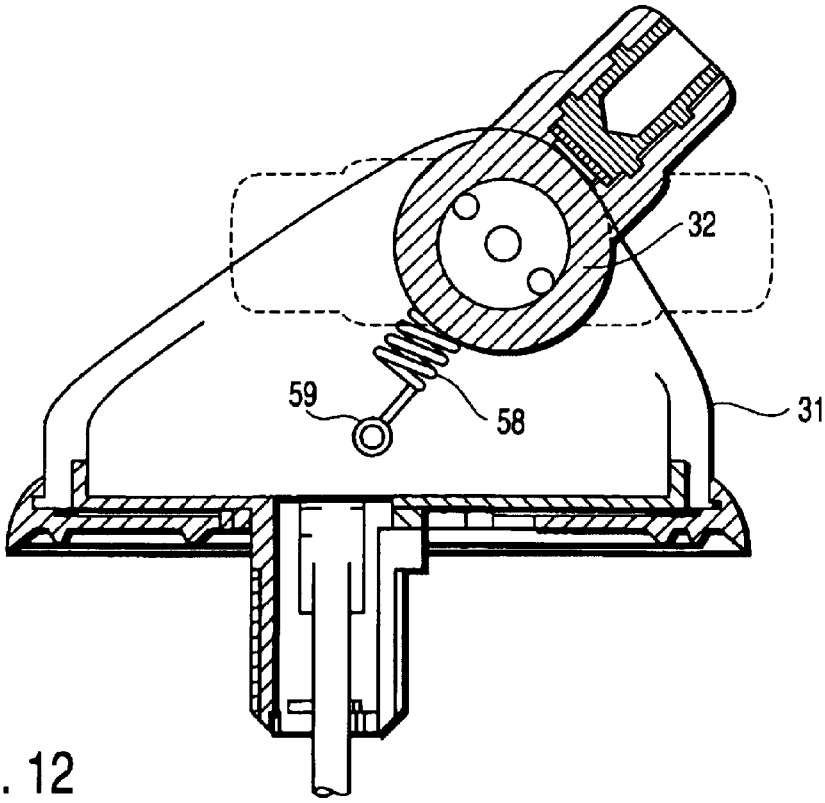
FIG. 12 is a view showing a structure of a vehicle roof mount antenna according to a fifth embodiment of the present invention.

FIG. 12 shows a structure of a vehicle roof mount antenna according to a fifth embodiment of the present invention.

In the drawing, one end of the coil spring 58 is attached one end of the joint assembly 32 on the side opposite to the antenna rod, and the other end of the coil spring 58 is fixed by an engagement portion 59 in the antenna base 31.

This coil spring 58 is constituted by a tension spring, and the engagement portion 59 is set at a position allowing return to a predetermined attachment angle position when no external force is applied to the antenna rod.

With such a structure, when the external force in either the front direction or the rear direction of a vehicle acts on the antenna rod, the antenna rod and the joint assembly 32 swivel in the direction along which the external force is applied while generating the tensile force by the coil spring 58.

Then, when the external force applied to the antenna rod is eliminated, the joint assembly 32 and the antenna rod smoothly automatically return to the original angle inclined toward the rear side of a vehicle by the tensile force generated in the coil spring 58.

In this case, when a coil spring which can constantly generate a certain degree of tensile force is selected as the coil spring 58, the antenna rod can be prevented from unstably swiveling from a predetermined attachment angle position by small vibrations of a vehicle.

As described above, although there is provided a very simple structure which can incorporate the spring mechanism without greatly changing the structure of the antenna apparatus which does not have the conventional spring mechanism, the smooth operation can be realized by adopting, e.g., an appropriate tension coil spring.

In addition, since the coil spring 58 can be also used as an electric signal wire and the structure of the terminal portion 312 of the pivotal support portion 31*b*, the terminal plate 34, the coil spring 33 and others shown in FIG. 1 can be simplified, the number of components as the entire antenna can be greatly decreased, which can contribute to reduction in cost.

It is to be noted that the antenna rod maintains the predetermined attachment angle position as long as the external force which is not less than a certain degree is not applied to the antenna rod as the shape with the center holding portion 57*a* being provided on the circumferential wall portion 57 as shown in FIG. 11 but this kind of holding mechanism may be also provided in the first to third and fifth embodiments.

In such a case, even if a damping force caused due to the elasticity of the spring mechanism is not largely applied, the antenna rod can be prevented from swiveling owing to small vibrations, thereby maintaining the stable attachment angle.

Additionally, the holding mechanism is not restricted to the structure shown in FIG. 11, and the structure is not limited as long as a feeling of clicking can be given to the antenna base 31 when the antenna rod is set at the predetermined attachment angle position by using any elastic body or the moderate latching operation is performed.

Further, although description has been given in connection with the first embodiment, when the antenna rod itself is configured to have a given degree of flexibility and the mechanism which releases the external force applied to the antenna rod is totally designed in the entire antenna together with the spring mechanism on the joint assembly 32 side and the antenna base 31 side, it is possible to realize the roof mount antenna requiring almost no maintenance by a user of a vehicle, which allows automatic and accurate return to a predetermined attachment angle position in the regular mode while assuredly preventing damages to the antenna rod and can maintain the stable electric wave reception operation without vibrating more than needs.

Besides, the present invention is not restricted to the foregoing embodiments, and various modifications can be carried out without departing from the scope of the invention.

Furthermore, the foregoing embodiments include the invention on various stages, and variety of inventions can be extracted by appropriate combinations of a plurality of disclosed structure requirements. For example, even if some of structure requirements are deleted from all the structure requirements described in the embodiments, the structure from which these structure requirements are deleted can be extracted as the invention when at least one of the problems described in the section "problems to be solved by the invention" can be solved and at least one of effects explained in the section "effects of the invention" can be obtained.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general invention concept as defined by the appended claims and their equivalents.

What is claimed is:

1. A vehicle roof mount antenna comprising:

an antenna rod;

an antenna base to which the antenna rod is attached in a manner so that the antenna rod is swivelable;

a joint portion which is provided at one end of the antenna rod and which comprises a cylindrical member having an axial direction orthogonal to an axial direction of the rod;

a pair of first and second pivotal support portions provided to confront an upper portion of the antenna base to mount the joint portion on a pivot in a swiveling manner;

a bolt and a nut which are inserted into a through hole provided in the first one of the pair of the pivotal support portions, which pierce the joint portion and the second one of the pair of pivotal support portions, and which are fastened together; and a spring mechanism which is provided with respect to the joint portion in the antenna base, and which automatically returns the joint portion and the antenna rod to a predetermined swiveling position in accordance with an elasticity of the spring mechanism, even if a swiveling position of the joint portion and the antenna rod is changed by an external force applied to the antenna rod.

2. The vehicle roof mount antenna according to claim 1, wherein the spring mechanism comprises a torsion spring which is coaxially arranged with respect to the joint portion, and wherein the spring mechanism has a first end fixed to an antenna base side and a second end fixed to a joint portion side.

3. The vehicle roof mount antenna according to claim 2, further comprising a cylindrical guide member which is provided in the torsion spring coaxially with the spring and the bolt, and which restricts partial reduction in inside diameter caused by entrainment of the torsion spring.

4. The vehicle roof antenna according to claim 2, wherein the spring mechanism also includes a holding mechanism which maintains the joint portion at a position where a swiveling angle of the joint portion is set at a predetermined position.

5. The vehicle roof mount antenna according to claim 1, wherein the spring mechanism comprises a torsion spring which is coaxially arranged with respect to the joint portion, and wherein the spring mechanism has both ends attached in accordance with two swiveling directions of the joint portion.

6. The vehicle roof mount antenna according to claim 5, further comprising a cylindrical guide member which is provided in the torsion spring coaxially with the spring and the bolt, and which restricts partial reduction in inside diameter caused by entrainment of the torsion spring.

7. The vehicle roof antenna according to claim 5, wherein the spring mechanism also includes a holding mechanism which maintains the joint portion at a position where a swiveling angle of the joint portion is set at a predetermined position.

8. The vehicle roof mount antenna according to claim 1, wherein the spring mechanism comprises a pair of coil springs each of which has a first end attached to the joint portion and a second end which is brought into contact with a wall surface in the antenna base by swiveling of the joint portion.

9. The vehicle roof antenna according to claim 8, wherein the spring mechanism also includes a holding mechanism which maintains the joint portion at a position where a swiveling angle of the joint portion is set at a predetermined position.

10. The vehicle roof mount antenna according to claim 1, wherein the spring mechanism comprises a coil spring having a first end attached to the joint portion and a second end fixed in the antenna base.

11. The vehicle roof antenna according to claim 10, wherein the spring mechanism also includes a holding mechanism which maintains the joint portion at a position where a swiveling angle of the joint portion is set at a predetermined position.

12. The vehicle roof mount antenna according to claim 1, wherein the spring mechanism includes:

a coil spring attached in such a manner that an axial direction thereof is parallel to a radial direction of a swiveling surface of the joint portion;

a slide member having a first end in contact with the coil spring and to which a force is given by elasticity of the coil spring; and a slide wall with which a second end of the slide member is in contact, which is formed in the antenna base, and which has a shape which weakens the elasticity of the coil spring to a lowest level when a swiveling angle of the joint portion is set at a predetermined position.

13. The vehicle roof antenna according to claim 12, wherein the spring mechanism also includes a holding mechanism which maintains the joint portion at a position where the swiveling angle of the joint portion is set at a predetermined position.

14. The vehicle roof antenna according to claim 1, wherein the spring mechanism includes a holding mechanism which maintains the joint portion at a position where a swiveling angle of the joint portion is set at a predetermined position.

* * * * *